US007275391B2

(12) United States Patent
Prinz et al.

(10) Patent No.: US 7,275,391 B2
(45) Date of Patent: Oct. 2, 2007

(54) ASSEMBLY FOR REFRIGERANT CIRCUITS

(75) Inventors: Dominik Prinz, Cologne (DE); Marc Graaf, Krefeld (DE)

(73) Assignee: Visteon Global Technologies, Inc., Van Buren Township, MI (US)

( * ) Notice: Subject to any disclaimer, the term of this patent is extended or adjusted under 35 U.S.C. 154(b) by 185 days.

(21) Appl. No.: 11/258,971

(22) Filed: Oct. 26, 2005

(65) Prior Publication Data

US 2006/0096313 A1 May 11, 2006

(30) Foreign Application Priority Data

Oct. 26, 2004 (DE) ..... 10 2004 053 272

(51) Int. Cl.
*F25B 43/00* (2006.01)

(52) U.S. Cl. ..... 62/474; 62/222; 62/511; 62/527

(58) Field of Classification Search ..... 62/474, 62/475, 511, 527, 222; 137/544, 550
See application file for complete search history.

(56) References Cited

U.S. PATENT DOCUMENTS 3,948,060 A * 4/1976 Gaspard ..... 62/175
4,756,166 A * 7/1988 Tomasov ..... 62/509
5,454,233 A * 10/1995 Naujock ..... 62/509
5,799,499 A * 9/1998 Yano et al. ..... 62/225
6,185,959 B1 2/2001 Zajac
6,397,616 B2 * 6/2002 Yamasaki et al. ..... 62/244
6,755,048 B2 6/2004 Maier

FOREIGN PATENT DOCUMENTS

DE 195 47 744 6/1997
EP 0 240 811 10/1987

* cited by examiner

*Primary Examiner*—Melvin Jones
(74) *Attorney, Agent, or Firm*—Brinks Hofer Gilson & Lione

(57) ABSTRACT

The invention relates to an assembly for refrigerant circuits that is arranged between the compressor and the evaporator thereof including a housing with a through channel. Within the through channel is a microchannel part having a filtering portion and a decompression portion wherein filtering and decompression of the passing refrigerant can be performed generally at the same time.

26 Claims, 2 Drawing Sheets

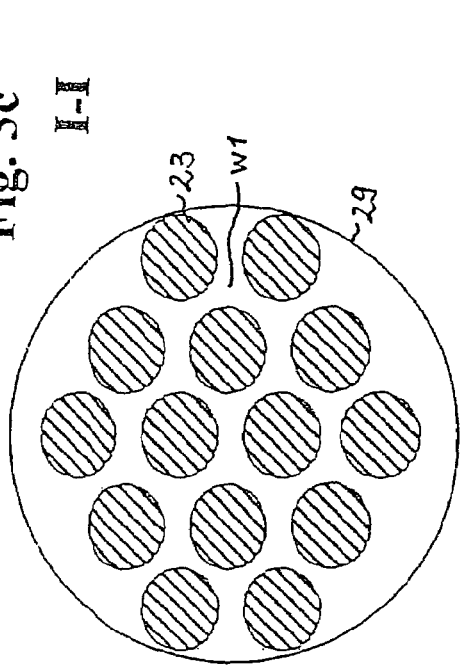
Fig. 3c
I-I
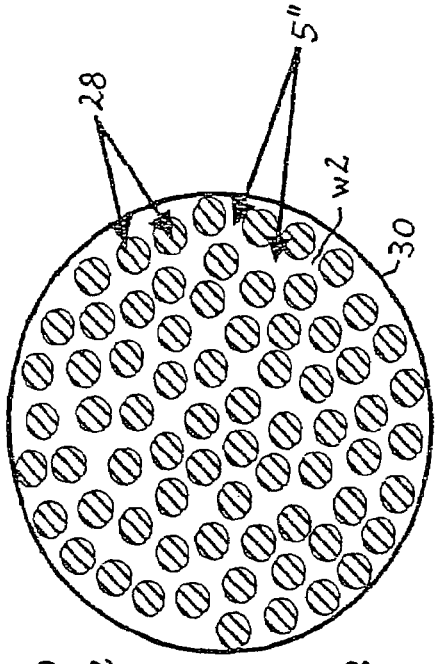
Fig. 3b
II-II
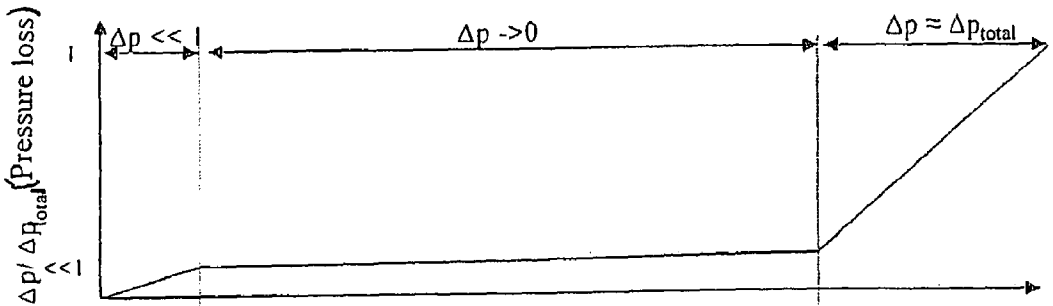
Fig. 3d
Fig. 3
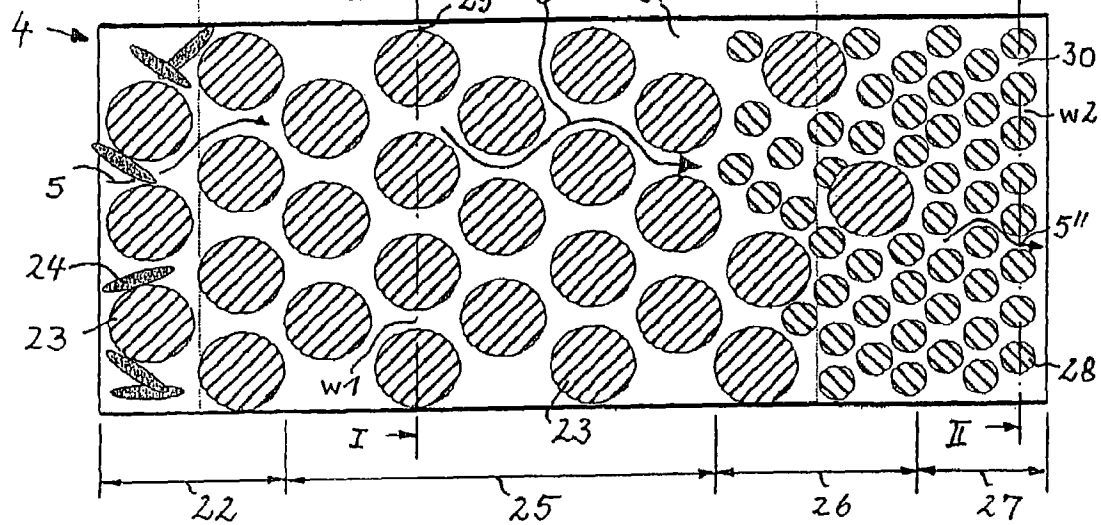
Fig. 3a

ASSEMBLY FOR REFRIGERANT CIRCUITS

BACKGROUND OF THE INVENTION

1. Field of the Invention

The invention relates to an assembly for refrigerant circuits that is arranged between the compressor and the evaporator thereof and includes a housing with a through channel.

2. Prior Technology

Within conventional vehicle air conditioning refrigerant circuits there are, on the one hand, at least one contaminant-removing filter and one decompression valve between a compressor and an evaporator and provided as assemblies at different positions of the refrigerant circuit in the connecting pipelines. Thereby, upstream of the respective decompression element, a filter is arranged either locally distanced and separated in order to prevent that the decompression element from being contaminated by foreign matter and/or plugged.

A locally distanced installation of both assemblies in a refrigerant circuit for vehicle air conditioning units is described in printed G 93 03 177.7. As provided therein a can-shaped separation device (a filter assembly) is installed that removes foreign fluids or foreign matter from the refrigerant. Then the cleaned refrigerant is directed to a decompression valve assembly which is locally separated from the separation device, and is decompressed there, before it is directed to the evaporator.

A spatial separation of both the assemblies within one housing in a refrigerant circuit, with a solenoid valve arranged therein, is described in U.S. Pat. No. 6,755,048. In order to prevent foreign matter from entering into the refrigerant circuit during the assembly process, this construction has at its inlet a particle filter arranged upstream in a housing containing both the assemblies. That means that the particle filter and the valve passage are arranged separately, spatially distanced from each other.

A refrigeration device with two evaporators is described in DE 195 47 744 A1. A drying device with a filter assembly positioned therein is contained in the refrigerant circuit upstream of the decompression devices, which are arranged upstream of both the evaporators. A solenoid valve is located between the drying and both the decompression devices, controlling the refrigerant flow into the evaporators. The decompression devices and the filter assembly are locally contained in the pipeline system thus being distanced from each other.

In U.S. Pat. No. 6,185,959 refrigeration system components with cartridge-associated heat decompression valves are described. The decompression valve is placed within a decompression valve-containing housing, which is designed in form of a cartridge, in the upper part of the cartridge housing and in the bottom space region a ring-like filter assembly is installed. The refrigerant fed in first passes the filter assembly, then a standpipe and is finally directed to the decompression valve. Therefore also here a spatial separation of the filter and decompression valve within one housing is given.

An arrangement for the control of a refrigeration circuit with a decompression capillary tube is described in EP 0 240 811 A1. On the input side a filter assembly is connected to the pipeline of the condenser and on the outlet side a longer capillary tube is placed downstream of the filter assembly as a decompression element directed to the evaporator. Thus a spatial succession of the filter assembly and the decompression element is provided.

In all above mentioned arrangements of filter assemblies and decompression assemblies both of the assemblies are, at least successively arranged one after the other separated from each other both physically and functionally, which causes high cost of the refrigerant circuits.

The invention aims at providing an assembly for refrigerant circuits that is suitably designed in such a way it is simply designed and cost-effective, being able to be installed in refrigerant circuits demanding less assembly effort.

BRIEF SUMMARY OF THE INVENTION

In the present assembly for refrigerant circuit, which is arranged between the compressor and the evaporator, a housing is provided with a through channel in which is located a microchannel part having a functional filter/decompression unit-body. In the microchannel part filtering and decompression of the passing refrigerant are performable substantially at the same time. Thus the filtering and the decompression of the flowing refrigerant are performed on the same level in the combined functional one-body microchannel part.

The microchannel part is provided with a filtering portion for holding foreign matter in free intermediate regions of microchannels and a decompression portion having reduced width microchannels. The microchannels have different channel sizes (w), whereby in direction of flow in the inlet region microchannels with bigger channel sizes (wI) are provided and in the outlet region microchannels with smaller channel sizes (w2) are provided. The microchannel part can be exchangeably designed arranged in a screwable holding part insertable into the through channel. The microchannel part can also be fixedly arrested in the through channel.

The microchannel part can be constructed of a mesh or hole material with different channel/mesh sizes or hole patterns realized therein.

The channel/mesh size w can taper in direction of flow in such a way that in the microchannels the combined decompression and filtering property exists as a compound material property.

Alternatively, the microchannel part can be formed of compressed grain layers with different microchannels as free regions within the flow cross-section, whereby starting from the high-pressure side there are wider microchannels, followed in direction of the low-pressure side by microchannels designed smaller. The structure of the microchannel part can be formed by sintered metal to form a porous structure with the different microchannels.

The assembly can also be designed as a cartridge-style assembly.

The invention also makes it possible to dampen existing or generated acoustic waves in the pipelines by means of the combinedly functional assembly. Thus sound transmission into the interior of the passenger compartment can be attenuated.

BRIEF DESCRIPTION OF THE DRAWINGS

The invention will be explained in greater detail by several embodiments with reference to several drawings.

FIGS. 3*a-d* are, respectively, an enlarged schematic longitudinal sectional view (FIG. 3*a*), two enlarged schematic transverse sectional views (FIGS. 3*b*, 3*c*) generally taken along line II-II and I-I through the microchannel part with differently designed magnitudes of the inner parts, and a schematic representation (FIG. 3*d*) of the pressure loss Δp over the length L of the microchannel part in direction of flow of the refrigerant.

DETAILED DESCRIPTION

Figure 1:
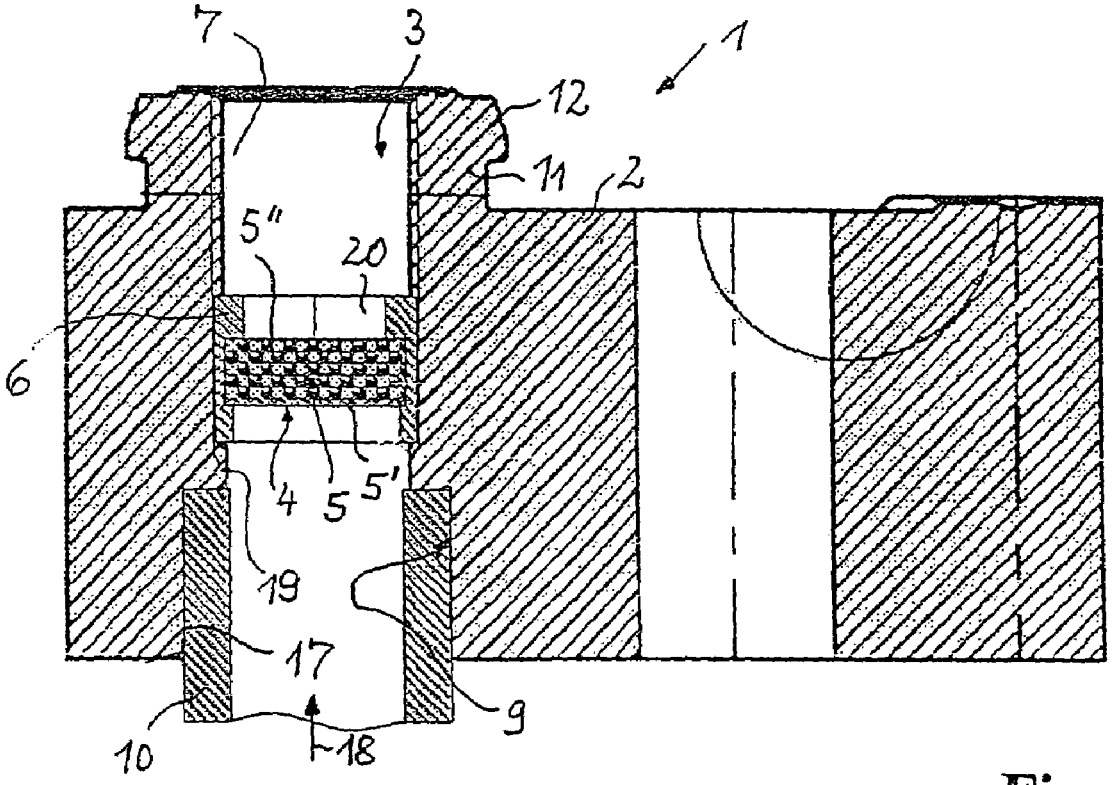
FIG. 1 is a schematic representation of a first assembly according to the invention for a refrigerant circuit in a longitudinal sectional view with an exchangeable microchannel part.

In FIG. 1 a first assembly 1 for a refrigerant circuit is shown which is arranged between the compressor (C) and the evaporator (E) of the refrigerant circuit and includes a housing 2 with a through channel 3.

According to the invention, the assembly 1 contains in the through channel 3 a microchannel part 4 designed as a functional filter/decompression unit-body and installed in a region within the through channel 3. In the microchannel part 4, filtering and decompression of the passing refrigerant are simultaneously performable in parallel.

The portion of the microchannel part 4 with the filtering property on the one hand, is provided to hold foreign matter 24 in existing free intermediate regions 5, 5' of the microchannel pat 4. The portion of the microchannel part 4 with the decompression property on the other hand, is provided by microchannel-sized tapering profiles given by averaging over all microchannels 5', 5" present within the cross-section and tapering in longitudinal view.

The numerous microchannels 5, 5', 5" present in the microchannel part 4 thus fulfill a two-fold function: holding of the foreign matter 24 of the inflowing refrigerant at walls and in the free intermediate regions of the microchannels 5, 5' and throttling of the velocity of flow of the refrigerant from the high-pressure side of the compressor in direction of the low-pressure side of the evaporator in the tapering microchannels 5', 5".

The through channel 3 is provided with, preferably, two fit holes 9, 7 which are an entry-side fit hole 9 and a first exit-side fit hole 7, whereby the inner diameter of the entry-side fit hole 9 corresponds to, preferably, the outer diameter of the insertable tube 10 of the compressor.

In FIG. 1 the microchannel part 4 is inserted into a ring-shaped holding part 6, which is arranged approximately in the central region of the through channel 3 in a first exit-side fit hole 7 and can be fixably retained therein from the exterior by means of a screw connection. Particularly, the holding part 6 can be designed as a screw rotatable from the exterior by, preferably, a hollow hexagon wrench and provided with, preferably, a hexagon recess 20, whereby the first exit-side fit hole 7 is provided with a thread into which the holding part 6 is fixedly screwable. Being the screwable holding part 6, it can itself be provided as an exchangeable holding part with the microchannel part 4.

Between the first exit-side fit hole 7 and the entry-side fit hole 9, a ring-shaped channel shoulder 19, narrowing the through channel 3, can be present as inner region of the arrangement and against which, on the side of the first exit-side fit hold 7, the holding part 6 with the microchannel part 4 contained therein bears and is fixable. The opposite side of the channel shoulder 19 is the end region of the entry-side fit hold 9, whereby the inserted tube 10 can bear against the channel shoulder 19. By this, the tube 10 of the compressor can be stably arrested in the entry-side fit hole 9 by soldering or brazing.

A socket 11 with a flange 12 is provided for the connection of the evaporator to the assembly 1, whereby the flange 12 functions for the direct attachment to the evaporator or the entry pipe (not shown) of the evaporator.

In one application of the assembly 1, the housing 2 can be arranged as a connecting block with the through channel 3 to connect pipes and/or components in the pipeline system of the compressor and the evaporator of the refrigerant circuit.

Figure 2:
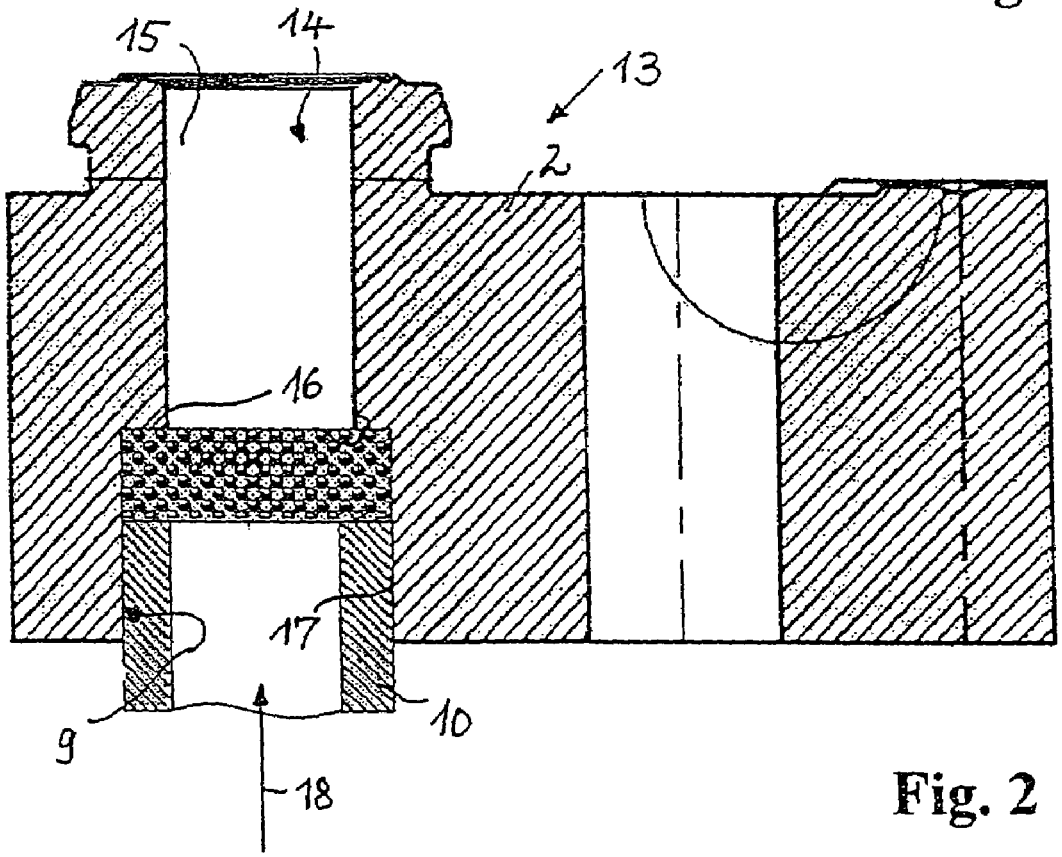
FIG. 2 is a schematic representation of a second assembly according to the invention for a refrigerant circuit in a longitudinal sectional view with fixedly installed microchannel part.

In another embodiment, as shown in FIG. 2, the second assembly 13 according to the invention is provided with a through channel 14 between an exit-side fit hole 15 and an entry-side fit hole 9. Within the through channel 14 is a one-stage channel-enlarging shoulder 16 against which the microchannel part 4 bears from the side of the entry-side fit hole 9 and to which it is fixable. The tube 10 inserted in the entry-side fit hole 9 can also function as an additional holding device of the microchannel part 4 against this shoulder 16 and can be stably soldered or brazed to the channel wall 17 and the housing 2. That means that, in general, the microchannel part 4 is fixedly arrested in the through channel 14.

As with the first embodiment, the refrigerant flows in direction of arrow 18 from the high-pressure side of the compressor (C) to the low-pressure side of the evaporator (E) in the refrigerant circuit.

The microchannel part 4, depending on the size of the through channel 14, can be provided in the form of full cylinder, a disk or a tablet.

The associated flow volume of the microchannel part 4 for the adjustment of the filtering decompression power can be selectively defined by the magnitude, thickness and dimensions of the inner components or structures of the microchannel part 4. In one construction, the microchannel part 4 can be provided with mesh or hole pattern's as inner components, whereby different mesh sizes or hold patters can be realized therein. Particularly, the mesh size w, the distance between adjacent components, can taper or reduce in the direction of flow 18 from wI to w2, so that in the region of the microchannel part 4, in a holistic bond, a combined functional filter-decompression property exists.

The microchannel part 4 can also be provided as a unitary structure via porous materials, particularly with sintered metal bodies forming the inner components.

In another construction of the assembly according to the invention, the microchannel part 4 can be compressed grain layers with different microchannels defined as free regions within the flow-cross-section, whereby starting from the high-pressure side (compressor side) there are wider microchannels 5', as schematically shown in FIG. 1, followed in direction of the low-pressure side (evaporator side) by microchannels 5" with holes, or meshes, respectively, designed smaller in form of small porosities.

As an alternative to the housing 2 in form of a connection block the assemblies 1 and 13 can be designed in form of a circuit-universally usable and cartridge-like assembly.

The function of a microchannel part 4 according to the invention is explained in greater detail in the longitudinal sectional view (FIG. 3*a*) and in the two cross-sectional views (FIGS. 3*b*, 3*c*). In the FIG. 3 the microchannels 5, 5', 5" are provided with different channel widths w, whereby in direction of flow 18 in the entry region microchannels 5, 5' with wider channel width w I and in the exit region microchannels 5" with narrower channel width w 2 are provided.

In FIG. 3*a* the microchannel part 4 is shown in a schematic longitudinal sectional view, designed as a cylindrical unitary body 21 with filling-like structure. A filing-like structure is typical for, e.g., sintered metal bodies. In the entry region 22 there are first sintered metal bodies 23, between which a given flow cross-section is defined, averaging over a cross-sectional area. In the entry region 22 particles 24 contaminating the refrigerant can deposit. In the central region 25, there are predominantly the first sintered metal bodies 23, the first cross-sectional area 29, which corresponds to the flow cross-section of approximately that of the entry region 22.

In subsequent transition zone 26, between the central region 25 and an exit region 27, the first, bigger-grained, sintered metal bodies 23 are interspersed with second, smaller-grained, sintered metal bodies 28 so that the flow cross-section is, on average, reduced. In the exit region 27, almost without exception, only the smaller second metal bodies 28 are present and these establish the smallest flow cross-section, as shown in FIG. 3*b*, in the second cross-sectional area 30. Also in this case, there is a filling-like structure of the second smaller-grained metal bodies 28.

According to this construction, the entry region 22 is established to have wider meshes than the exit region 27, as shown in the FIGS. 3*b* and 3*c*. Also, the mesh size wI averaging over the first cross-sectional area 29 (FIG. 3*c*) is significantly wider than the mesh size w2 averaging over the second cross-sectional area 30 (FIG. 3*b*) of the cylindrical body 21.

Porous material, such as sintered meta, with filling-like structure can be used because it is highly capable to reduce the pressure from a high-pressure side to a low-pressure side in a refrigerant circuit and, at the same time, to filter foreign matter 24 from the refrigerant. Due to the tapering of the microchannels from 5, 5' to 5" present, on average, over the given length L in the longitudinal section, apart from the initial filtering, decompression of the refrigerant is achieved.

In FIG. 3*d* the course of the pressure loss $\Delta p$ in the microchannel part 4 over the length L of the cylindrical body 21 is shown. In the entry region 22 a very small, slightly increasing pressure drop is observed with $\Delta p \ll 1$, due to the bond of the particles 24. In the central region 25, due to the essentially constant, original flow cross-section, the pressure drop $\Delta p$ largely remains on the same level. Only in the transition zone 26, and then, in particular, in the exit region 27, the pressure drop $\Delta p$ rises rapidly according to the refrigerant decompression design criteria of the system.

The assembly 1 according to the invention can be provided with the following dimensional data of the microchannel part 4, or be in the following order of magnitude, for a vehicle air conditioning unit as an example: diameter of the complete cylinder approx. 2 to 20 mm, preferably 4 mm; length approx. 2 to 20 mm, preferably 3 mm; filter classes between 1 μm to 100 μm, preferably 1 μm. Obviously, for other applications different dimensions may be necessary in order to enable the adjustment of the defined refrigerant flow rates and pressure differences $\Delta p$.

The invention opens up the possibility that in addition to the combination of both the filtering and decompression properties within one body 21 of the microchannel part 4 shown with the microchannels 5, 5', 5", the reduction of the flow-born noise can be brought about as third property. The channel-tapering filling-like structure can break the sound waves in the pipelines and thereby damp the transmission of sound into the interior of the passenger compartment. The assembly 1, or 13, respectively, of the invention is therefore also a sound reducing device.

The invention also makes it possible to prolong the maintenance intervals for contamination of the entry region 22. The entry region 22 and the central region 25 with the first metal bodies having bigger grains and a wider flow cross-section avoid a possible throttling effect being generated already in the two regions 22, 25 due to contamination by the foreign particles 24. The assembly of the invention is universally usable for all refrigerant circuits.

The invention claimed is:

1. An assembly for a refrigerant circuit arranged between a compressor and an evaporator thereof, the assembly comprising:

a housing with a through channel defined therein, the through channel having an entry-side orifice and an exit-side orifice;

a microchannel part located within the through channel and configured as a functional filter/decompression unit-body; and the microchannel part including a filtering portion and a decompression portion, whereby filtering and decompression of refrigerant passing through the assembly is performable substantially at the same time by the microchannel part.

2. The assembly of claim 1 wherein the filtering portion includes first microchannels of a first average width defining free intermediate regions configured to capture foreign matter therein, and the decompression portion includes second microchannels of a second average width being reduced in size relative to the first microchannels of the filtering portion.

3. The assembly of claim 2 wherein the first and second microchannels are defined by inner components of the microchannel part.

4. The assembly of claim 2 wherein an inlet region of the microchannel part is provided with the first microchannels and an outlet region of the microchannel part is provided with the second microchannels.

5. The assembly of claim 1 wherein an inner diameter of the entry-side orifice corresponds to an outer diameter of an insertable tube of the compressor.

6. The assembly of claim 1 wherein the microchannel part is inserted into a ring-shaped holder located generally in a central region of the through channel.

7. The assembly of claim 6 wherein the ring shaped holder is secured to the housing by a threaded connection.

8. The assembly of claim 6 wherein the ring shaped holder is introducible into the housing through the exit-side orifice.

9. The assembly of claim 6 wherein the holding part is formed as a hexagon socket head cap screw having a hexagon recess through which refrigerant is passable.

10. The assembly of claim 6 wherein a channel sleeve is located between the exit-side orifice and the entry-side orifice, the channel sleeve narrowing the through channel in the area of the channel sleeve and the holding part being fixed against the channel sleeve.

11. The assembly of claim 10 wherein an inlet tube bears against the channel sleeve through the entry-side orifice and is fixedly retained there against.

12. The assembly of claim 6 wherein the ring shaped holder is removeably engaged with the through channel.

13. The assembly of claim 1 wherein at the exit-side orifice the housing includes an attachable socket having a flange configured to provide attachment to a connection coupled to the evaporator.

14. The assembly of claim 1 wherein the housing is a generally solid connecting block.

15. The assembly of claim 1 wherein the through channel includes a shoulder located between the exit-side orifice and the entry-side orifice, the microchannel part bearing against the shoulder.

16. The assembly of claim 15 wherein an outlet tube is located into the housing through the exit-side orifice and cooperates to retain the microchannel part in the through channel.

17. The assembly of claim 15 wherein the microchannel part is fixedly retained in the through channel against the shoulder.

18. The assembly of claim 1 wherein the microchannel part is in the shape of one of a cylindrical body, disk or tablet.

19. The assembly of claim 1 wherein the microchannel part is formed of a mesh material having different mesh sizes defined therein and defining the first and second microchannels.

20. The assembly of claim 19 wherein the mesh sizes are reduced in size in a flow direction through the through channel.

21. The assembly of claim 1 wherein the microchannel part is a porous sintered body having sintered metal bodies as inner components defining the first and second microchannels.

22. The assembly of claim 1 wherein the microchannel part includes compressed grain layers defining the first and second microchannels as free regions within the flow cross-section of the compressed grain layers, whereby in the direction of flow through the through channel the first and second microchannels decrease in cross-sectional flow area.

23. The assembly of claim 1 wherein the microchannel part is a cylindrical filled structure, whereby in an entry region of the microchannel part there are located first sintered metal bodies between which cross-sectional flow is defined, in a subsequent central region the microchannel part there are also located sintered metal bodies that define a cross-sectional flow that is generally the same as that of the entry region, whereby in a subsequent transition zone between the central region and an exit region the first sintered metal bodies are interspersed with second sintered metal bodies of a smaller size than the first sintered metal bodies and defining a reduced cross-sectional flow in the exit region.

24. The assembly of claim 23 wherein the filled structure is defined by a plurality of sintered metal bodies.

25. The assembly of claim 1 further comprising means for dampening sound waves in the circuit.

26. The assembly of claim 1 in the form of a cartridge.

* * * * *